US010357069B2

(12) United States Patent
Tuan

(10) Patent No.: US 10,357,069 B2
(45) Date of Patent: Jul. 23, 2019

(54) GAUZE MASK WITH FOLDING LINES CAPABLE OF ENABLING THE GAUZE MASK TO BE FOLDED INTO A FLAT PACKAGE OR UNFOLDED INTO A THREE DIMENSIONAL CONFIGURATION

(71) Applicant: Ronald Tuan, Nantou County (TW)

(72) Inventor: Ronald Tuan, Nantou County (TW)

( * ) Notice: Subject to any disclaimer, the term of this patent is extended or adjusted under 35 U.S.C. 154(b) by 505 days.

(21) Appl. No.: 15/187,767

(22) Filed: Jun. 20, 2016

(65) Prior Publication Data

US 2017/0360125 A1 Dec. 21, 2017

(51) Int. Cl.
*A41D 13/11* (2006.01)

(52) U.S. Cl.
CPC ..... *A41D 13/1107* (2013.01); *A41D 13/1169* (2013.01)

(58) Field of Classification Search
CPC ..... A41D 13/1115; A41D 13/1123; A41D 13/1107
See application file for complete search history.

(56) References Cited

U.S. PATENT DOCUMENTS 3,613,678 A * 10/1971 Mayhew ..... A41D 13/1115 128/206.19
4,248,220 A * 2/1981 White ..... A41D 13/1123 128/206.16
4,300,549 A * 11/1981 Parker ..... A41D 13/1115 128/206.12
6,536,434 B1 * 3/2003 Bostock ..... A41D 13/1115 128/206.12
7,210,482 B2 * 5/2007 Huang ..... A41D 13/1115 128/205.25
7,725,948 B2 * 6/2010 Steindorf ..... A41D 13/1115 2/206
8,251,065 B2 * 8/2012 Kim ..... A62B 23/025 128/206.19
8,881,729 B2 * 11/2014 Duffy ..... A41D 13/1115 128/206.19
9,421,294 B2 * 8/2016 Yamada ..... B01D 39/16
9,603,395 B2 * 3/2017 Duffy ..... A41D 13/1115
9,878,063 B2 * 1/2018 Yamada ..... A62B 18/02
D819,800 S * 6/2018 Tuan ..... D24/110.1
2006/0130842 A1 * 6/2006 Kleman ..... A41D 13/11 128/206.19
2008/0271739 A1 * 11/2008 Facer ..... A41D 13/11 128/206.19
2011/0271955 A1 * 11/2011 Palomo ..... A41D 13/1115 128/201.17
2012/0060258 A1 * 3/2012 Stewart ..... A41D 13/1107 2/206

(Continued)

*Primary Examiner* — Richale L Quinn
(74) *Attorney, Agent, or Firm* — Bruce Stone LLP; Joseph Bruce

(57) ABSTRACT

A gauze mask with folding lines capable of enabling the gauze mask to be folded into a flat package or unfolded into a three dimensional configuration, includes two folding portions connected to a main covering portion and two main pieces. Each of the two folding portions includes at least three folding pieces, when in use, the folding pieces will be stretched out and prop up one another, which provides a better support and enables to the gauze mask to be unfolded into a three dimensional structure. When unfolded, the gauze mask can obtain a strong support and three dimensional sense.

10 Claims, 13 Drawing Sheets

(56) References Cited

U.S. PATENT DOCUMENTS

| | | | | |
|---|---|---|---|---|
| 2015/0056102 | A1* | 2/2015 | Yamada | B01D 39/16 422/120 |
| 2015/0059772 | A1* | 3/2015 | Duffy | A41D 13/1115 128/863 |
| 2016/0016021 | A1* | 1/2016 | Duffy | A62B 23/025 128/863 |
| 2016/0151650 | A1* | 6/2016 | Reese | A62B 23/025 128/863 |
| 2018/0295907 | A1* | 10/2018 | Ahoubim | A41D 13/1115 |

* cited by examiner

GAUZE MASK WITH FOLDING LINES CAPABLE OF ENABLING THE GAUZE MASK TO BE FOLDED INTO A FLAT PACKAGE OR UNFOLDED INTO A THREE DIMENSIONAL CONFIGURATION

BACKGROUND

Field of the Invention

The present invention relates to a foldable gauze mask, and more particularly to a gauze mask with folding lines capable of enabling the gauze mask to be folded into a flat package or unfolded into a three dimensional configuration.

Related Prior Art

Normally, a conventional folding gauze mask is provided with folding lines, and the folding lines are parallel and have the same folding direction. The conventional folding gauze mask is further provided with elastic ear loops at two ends of the mask body, and such folding gauze mask has the following disadvantages:

Firstly, the folding lines are parallel and have the same folding direction, which is unable to provide enough support when the gauze mask is unfolded into a three dimensional structure due to the fact that the three dimensional gauze mask is restricted by the respective layers of folding lines.

Secondly, the folding lines are parallel and have the same folding direction, the support portions along the folding lines will be misaligned when the gauze mask is unfolded into a three dimensional structure, as a result, the support force will be unfocused. Furthermore, the gauze mask cannot be folded flatly.

Finally, the gauze mask is provided with the ear loops, when in the unfolded position, both ends of the gauze mask will be pulled by the elastic ear loops to form semi-arch-shaped openings, which consequently affects the sealing performance of the gauze mask.

The present invention has arisen to mitigate and/or obviate the afore-described disadvantages.

SUMMARY

The present invention is aimed at providing a gauze mask with folding lines capable of enabling the gauze mask to be folded into a flat package or unfolded into a three dimensional configuration, when unfolded, the gauze mask can obtain a strong support and three dimensional sense.

Besides, the gauze mask of the present invention can be easily and quickly folded into a flat package for easy storage.

The present invention is further aimed at improving the sealing performance of the gauze mask, consequently improving the filtering performance against dirty air and dust.

Therefore, a gauze mask with folding lines capable of enabling the gauze mask to be folded into a flat package or unfolded into a three dimensional configuration, comprisies: two main pieces, two folding portions and a main covering portion which are connected to one another and extend along a transverse direction, wherein each of the main pieces, the folding portions and the main covering portion includes a first end and a second end along the transverse direction, the first ends of the main pieces, the folding portions and the main covering portion are stacked one upon another, and the second ends of the main pieces, the folding portions and the main covering portion are also stacked one upon another, each of the main pieces, the folding portions and the main covering portion includes a press connecting portion which is located at each of positions where the first ends and the second ends of the main pieces, the folding portions and the main covering portion are stacked one upon another;

the two main pieces are arranged in a pulling direction which is in perpendicular to the transverse direction, and are designed to rest against a user's face;

the two folding portions are connected between the two main pieces and the main covering portion, and each include at least three folding pieces which are connected one another in sequence;

two ends of the main covering portion in the pulling direction are connected to the two folding portions; and an adhesive layer is disposed at the two main pieces to adhere the main pieces to the user's face;

when in a folded position, the two main pieces are located adjacent to each other, and the folding pieces are stacked upon one another, and when in a unfolded position, the two main pieces are located farther away from each other along the transverse direction, the first and second ends of the two main pieces are still stacked upon one another, while the folding pieces are pulled away from one another in a non-stacked manner, so as to form a three dimensional structure.

Preferably, the main pieces and the folding portions include a continually extending three-dimensional folding line.

Preferably, the gauze mask is provided with a relief notch at the first and second ends.

As mentioned above, the gauze mask of the present invention has the two folding portions connected to the main covering portion and the two main pieces. Since each of the two folding portions includes at least three folding pieces, when in use, the folding pieces will be stretched out and prop up one another, which provides a better support and enables to the gauze mask to be unfolded into a three dimensional structure.

With the arrangement of the main cover portion, the main pieces and the folding portions enables the formation of the three-dimensional folding line, which makes the support force more focused when the gauze mask is unfolded into a three dimensional configuration.

Besides, the relief notch at the first ends and the second ends, and prevents the connecting portions of the main pieces and the folding portions at the first ends and the second ends from getting wrinkled and affecting the sealing performance of the gauze mask.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

DETAILED DESCRIPTION

The present invention will be clearer from the following description when viewed together with the accompanying drawings, which show, for purpose of illustrations only, the preferred embodiment in accordance with the present invention.

Referring to FIGS. 1-14, a gauze mask S with folding lines capable of enabling the gauze mask to be folded into a flat package or unfolded into a three dimensional configuration is shown in accordance with the preferred embodiment of the present invention, and comprises: two main pieces 10, two folding portions 20 and a main covering portion 30 which are connected to one another and extend along a transverse direction X.

Figure 12:
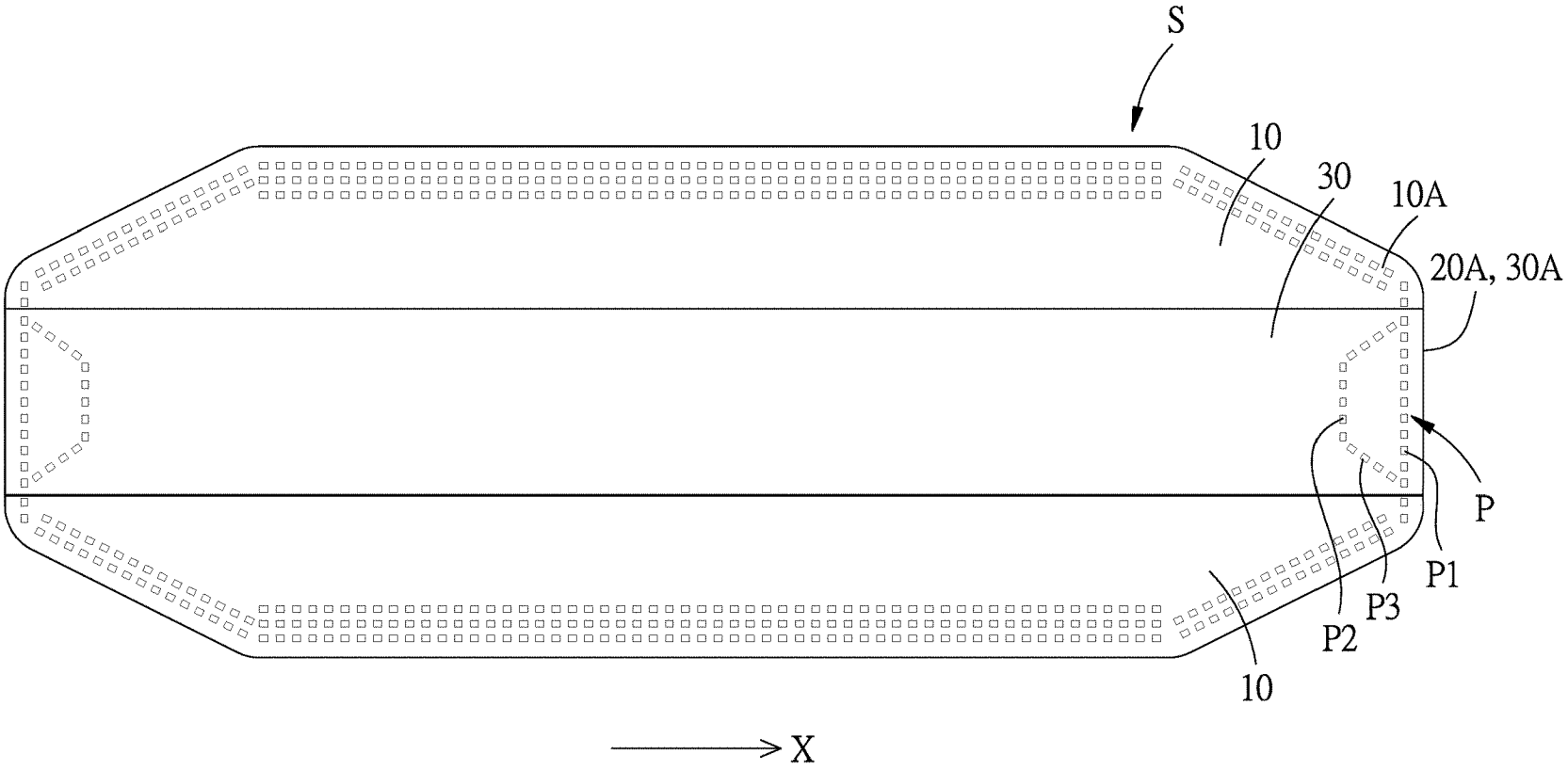
FIG. 12 is a plan view in accordance with the second preferred embodiment of the present invention showing that the gauze mask with folding lines is folded into a flat package.
Figure 13:
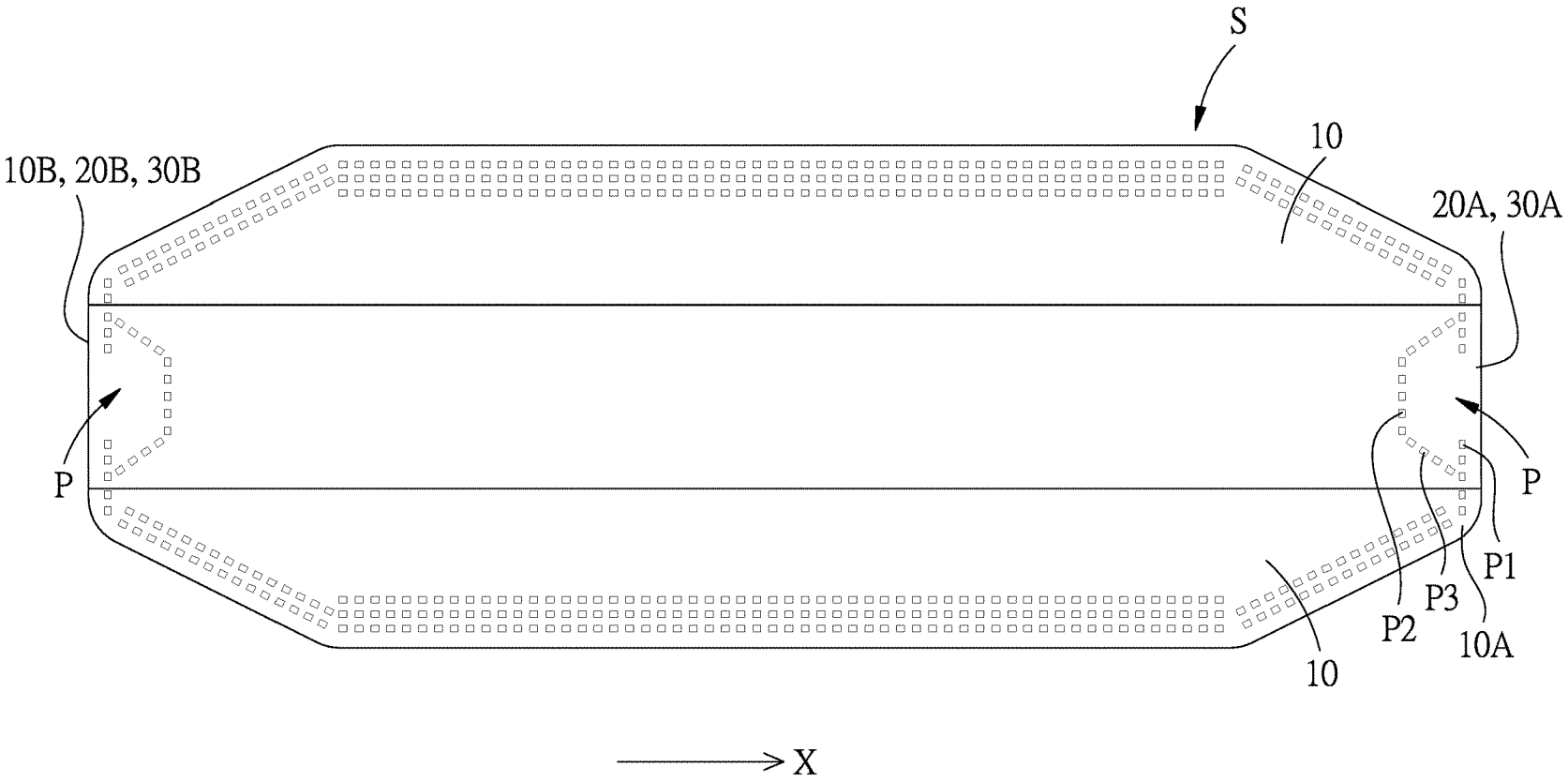
FIG. 13 is another plan view in accordance with the second preferred embodiment of the present invention showing that the gauze mask with folding lines is folded into a flat package.

Each of the main pieces 10, the folding portions 20 and the main covering portion 30 includes a first end 10A, 20A, 30A and a second end 10B, 20B, 30B along the transverse direction X. The first ends 10A, 20A and 30A are stacked one upon another, and the second ends 10B, 20B and 30B are also stacked one upon another. Each of the main pieces 10, the folding portions 20 and the main covering portion 30 includes a press connecting portion P which is located at each of the positions where the first ends 10A, 20A and 30A are stacked one upon another, and the second ends 10B, 20B and 30B are stacked one upon another. As shown in FIG. 12, the press connecting portion P includes a width, and further includes a first edge P1, a second edge P2 which is spaced from and shorter than the first edge P1, and two inclined edges P3 connected between the first and second edges P1, P2, so that the press connecting portion P is trapezoid-shaped. In this embodiment, the press connecting portion P is defined by the second edge P2 and the two inclined edges P3 connected to two ends of the second edge P2.

The two main pieces 10 are arranged in a pulling direction Y which is in perpendicular to the transverse direction X, and each include a mating edge 101 along the pulling direction Y. The two mating edges 101 are located adjacent to each other, and the two main pieces 10 are designed to rest against the user's face.

The two folding portions 20 are connected between the two main pieces 10 and the main covering portion 30, and each include a first connecting edge 201 and a second connecting edge 20J. The two first connecting edges 201 are connected to the mating edges 101 of the two main pieces 10. Each of the folding portions 20 includes at least three folding pieces 200 which are connected one another in sequence. In this embodiment, each of the folding portions 20 includes three folding pieces 200, which are a first folding piece 201, a second folding piece 202 and a third folding piece 203. The first connecting edges 201 are located at the first folding pieces 201, respectively, and the first folding pieces 201 are connected to the main pieces 10, respectively. At each of the positions where the first folding pieces 201 connect the main pieces 10 is formed a first folding line U1. At each of the positions where the first and second folding pieces 201, 202 are connected is defined a second folding line U2. At each of the positions where each of the third folding pieces 203 has one edge connected to a corresponding one of the second folding pieces 202 is defined a third folding line U3. Another edge of each of the third folding pieces 203 opposite to the edge connected to a corresponding one of the second folding pieces 202 is the second connecting edge 20J which is connected to the main covering portion 30. At each of the positions where the main covering portion 30 connects the third folding pieces 203 is defined a fourth folding line U4. The first and third folding lines U1, U3 have the same folding direction, and the second and fourth folding lines U2, U4 have the same folding direction.

Figure 4:
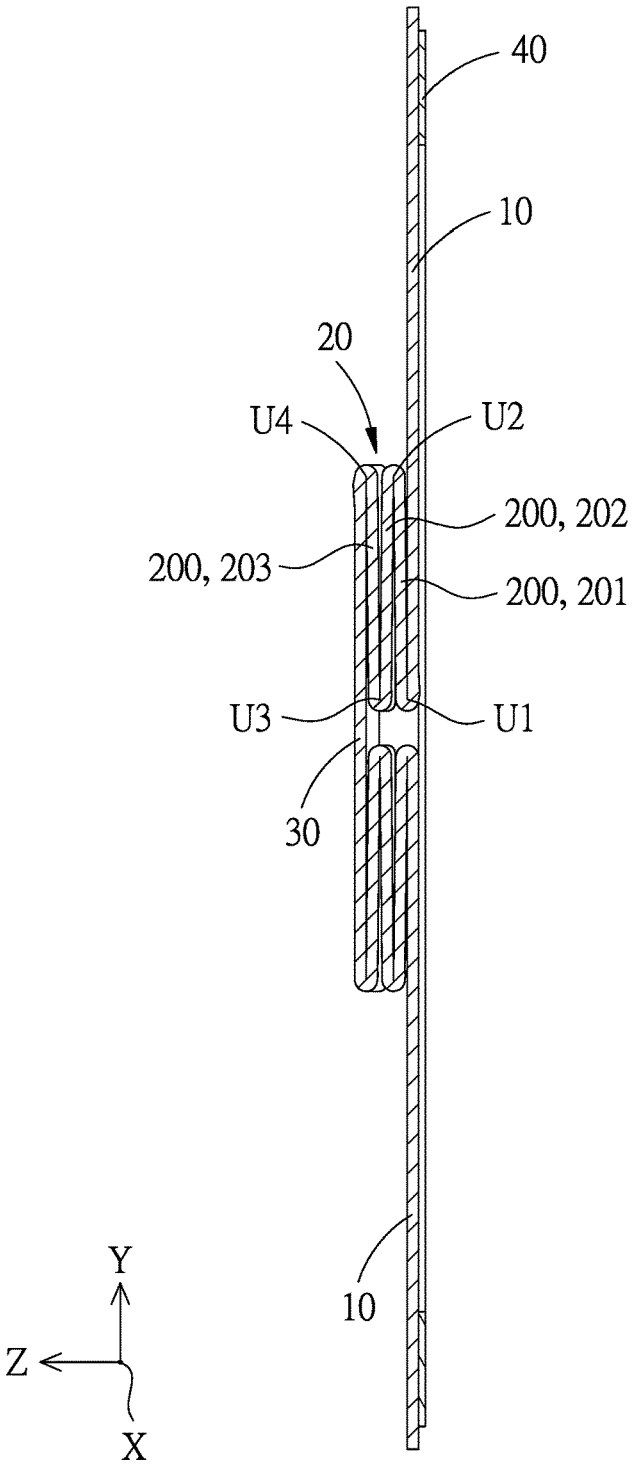
FIG. 4 is a cross sectional view showing that the gauze mask with folding lines in accordance with the preferred embodiment of the present invention is folded into a flat package.

When the gauze mask of the present invention is in the folded position, as shown in FIG. 4, the first, second and third folding pieces 201, 202 and 203 extend along the pulling direction Y, and are arranged in a parallel side-by-side relation along a three-dimensional direction Z which is perpendicular to the transverse direction X and the pulling direction Y.

Figure 5:
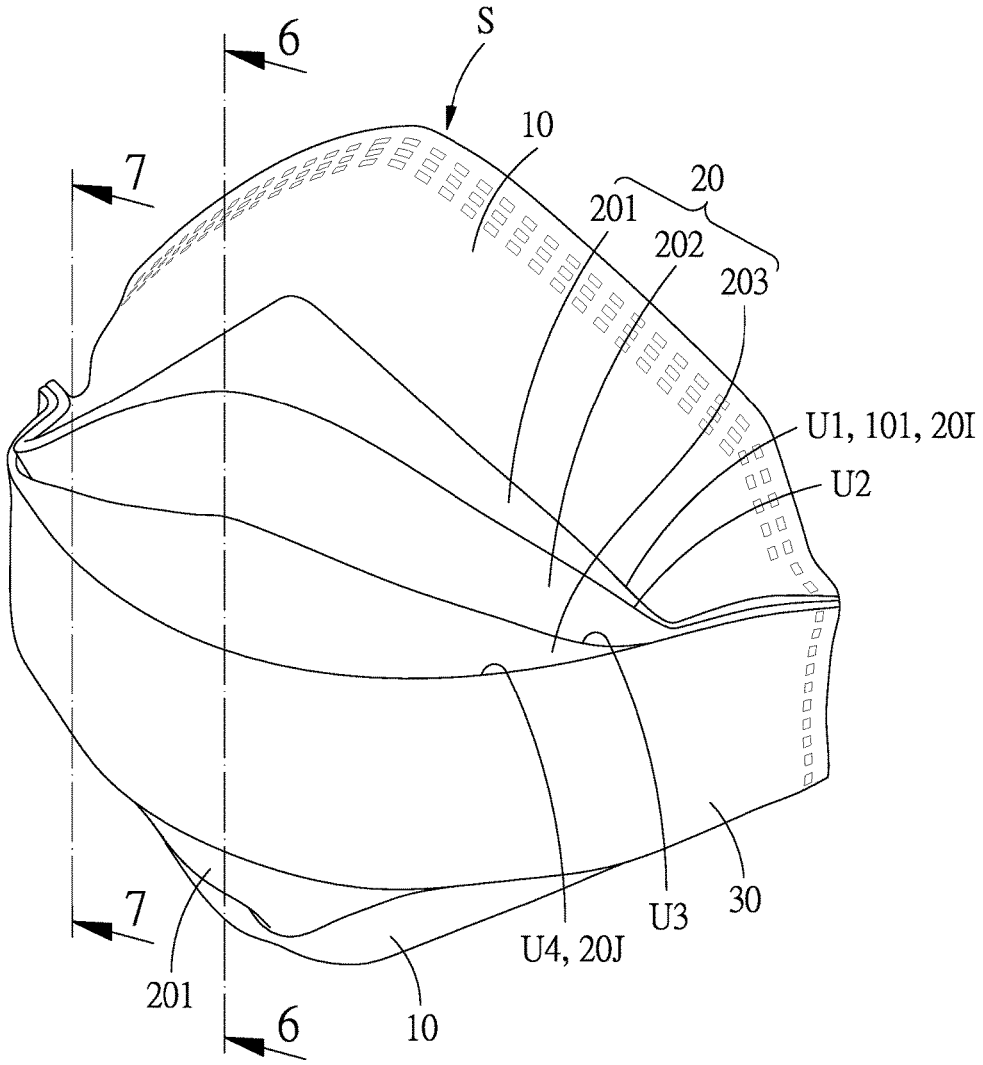
FIG. 5 is a perspective view in accordance with the preferred embodiment of the present invention showing that the gauze mask with folding lines is unfolded into a three dimensional configuration.
Figure 6:
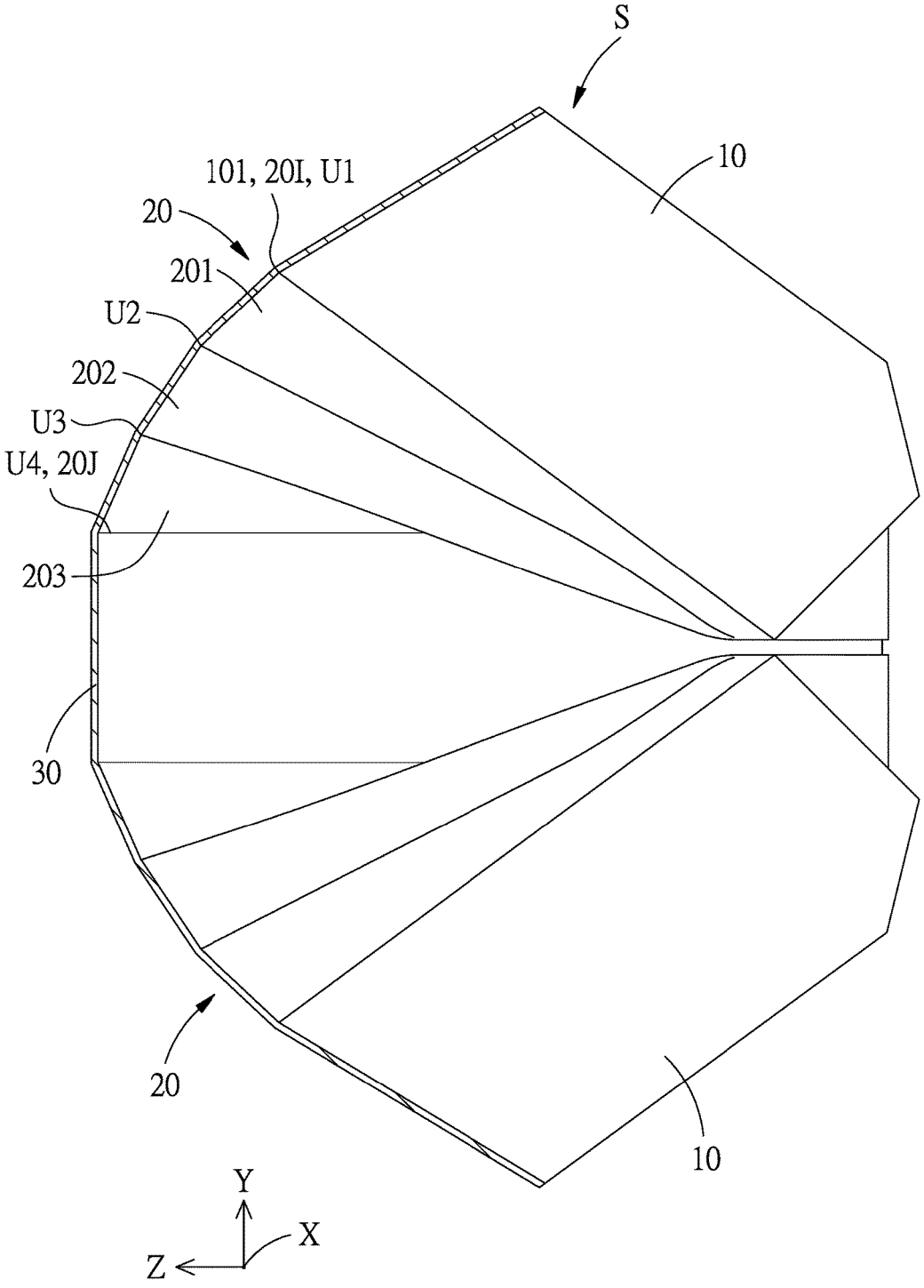
FIG. 6 is a cross sectional view taken along the line 6-6 of FIG. 5.
Figure 7:
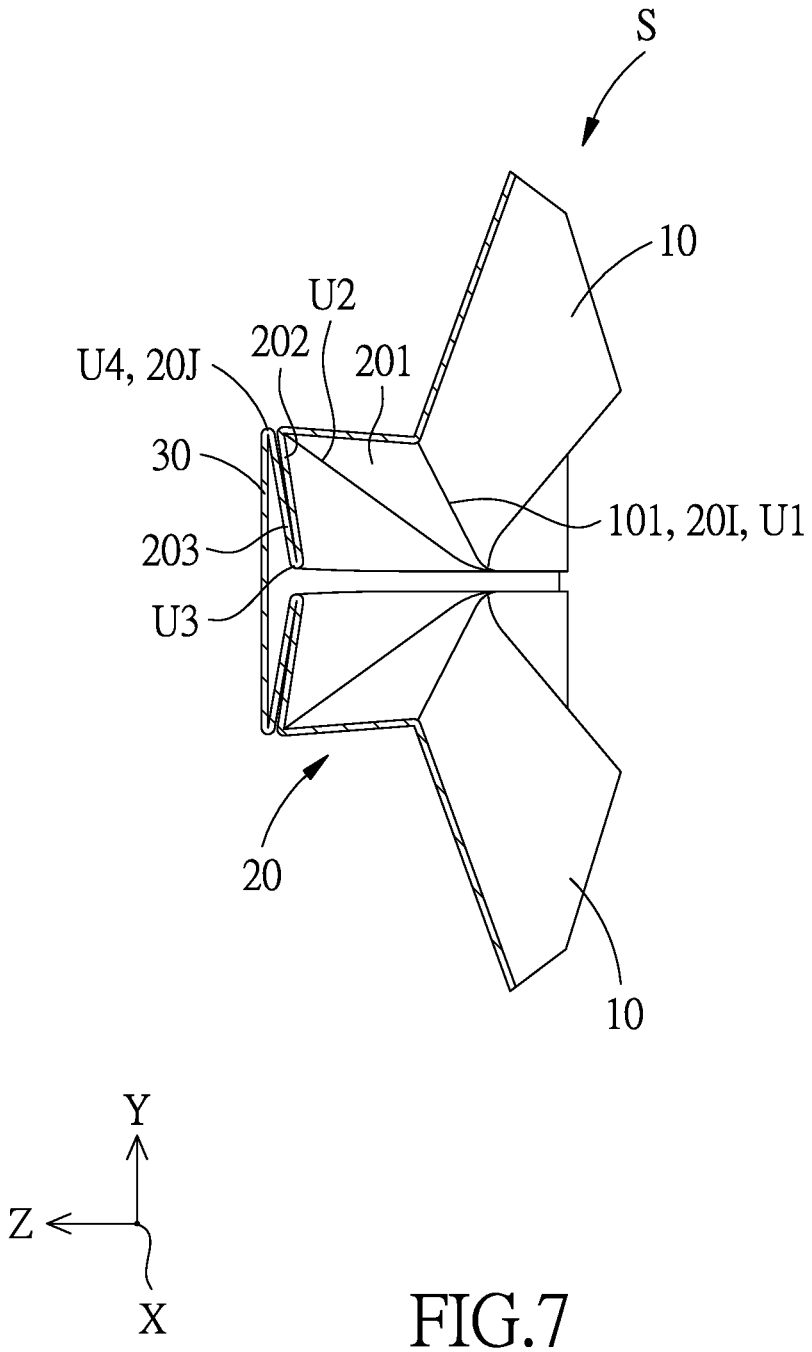
FIG. 7 is a cross sectional view taken along the line 7-7 of FIG. 5.
Figure 8:
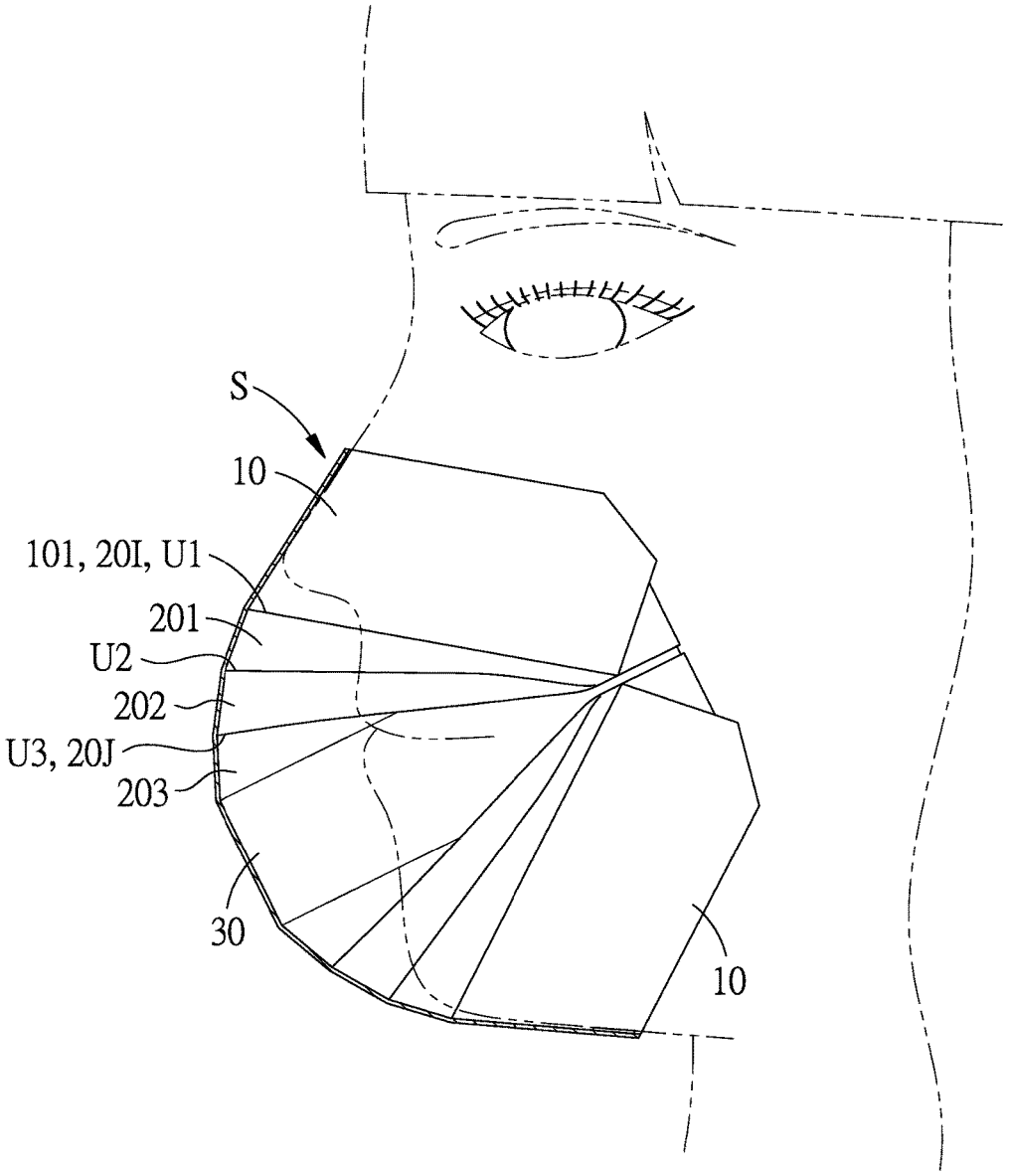
FIG. 8 is an illustrative view showing that the gauze mask with folding lines in accordance with the preferred embodiment of the present invention is worn on a user's face.

When the gauze mask of the present invention is in the unfolded position, as shown in FIG. 5, the first, second and third folding pieces 201, 202 and 203 are stretched out and prop up one another. The prop-up force of the first, second and third folding pieces 201, 202 and 203 allows the gauze mask S of the present invention to be unfolded into a three dimensional configuration.

Two ends of the main covering portion 30 in the pulling direction Y are connected to the second connecting edge 20J of the third folding pieces 203 of the two folding portions 20.

Figure 1:
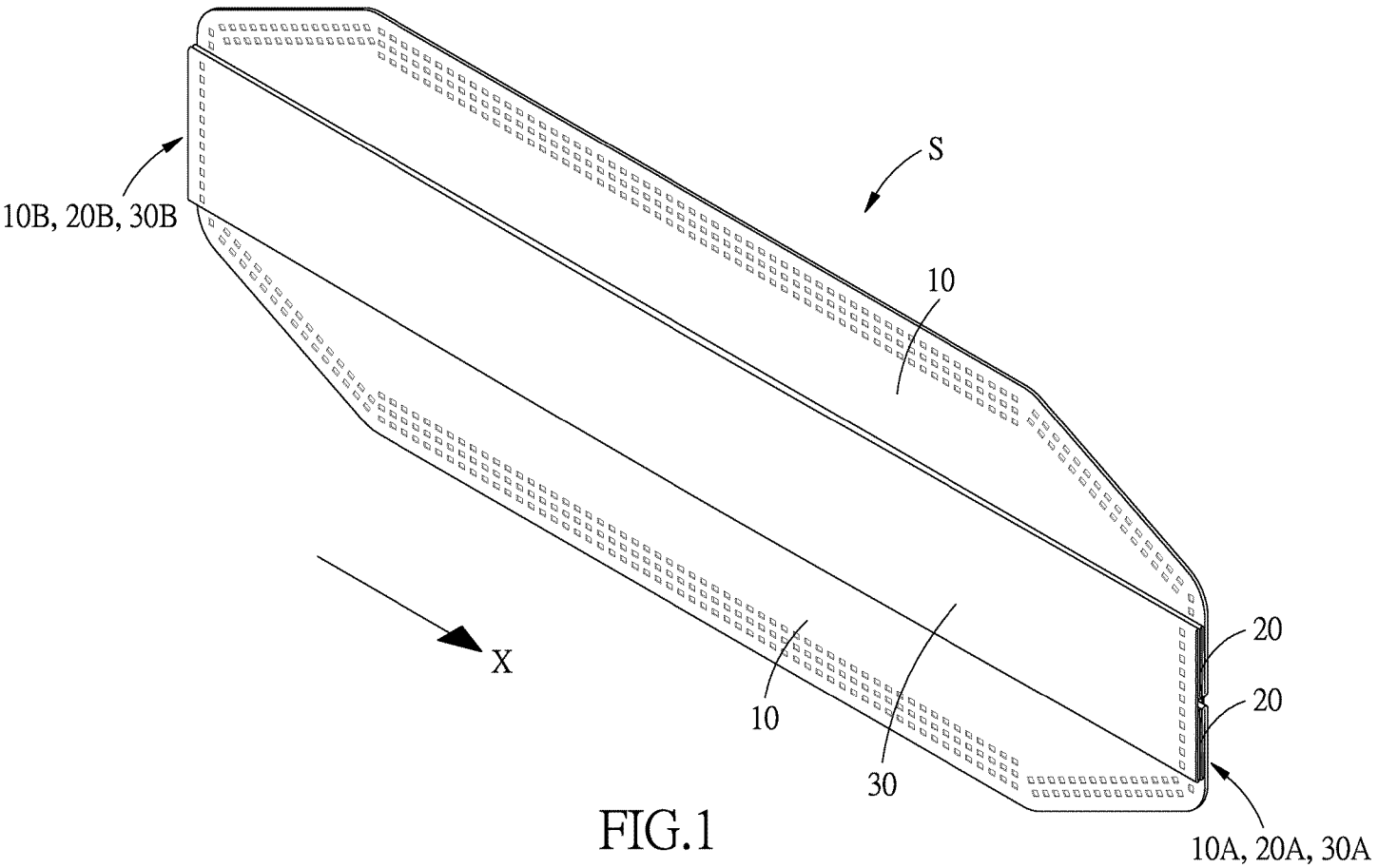
FIG. 1 is a perspective view in accordance with a preferred embodiment of the present invention showing that a gauze mask with folding lines is folded into a flat package.
Figure 2:
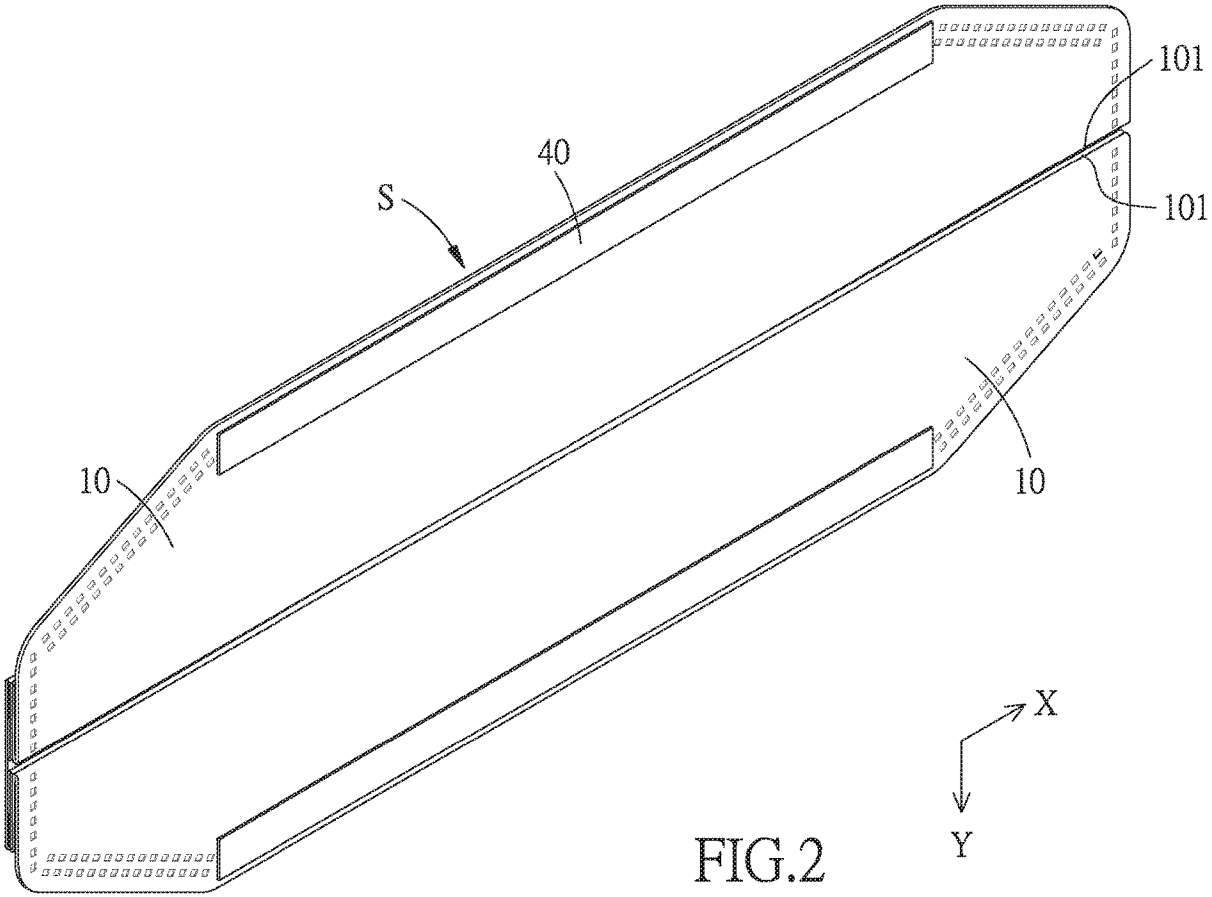
FIG. 2 is a perspective view in accordance with the preferred embodiment of the present invention from another angle showing that the gauze mask with folding lines is folded into a flat package.
Figure 3:
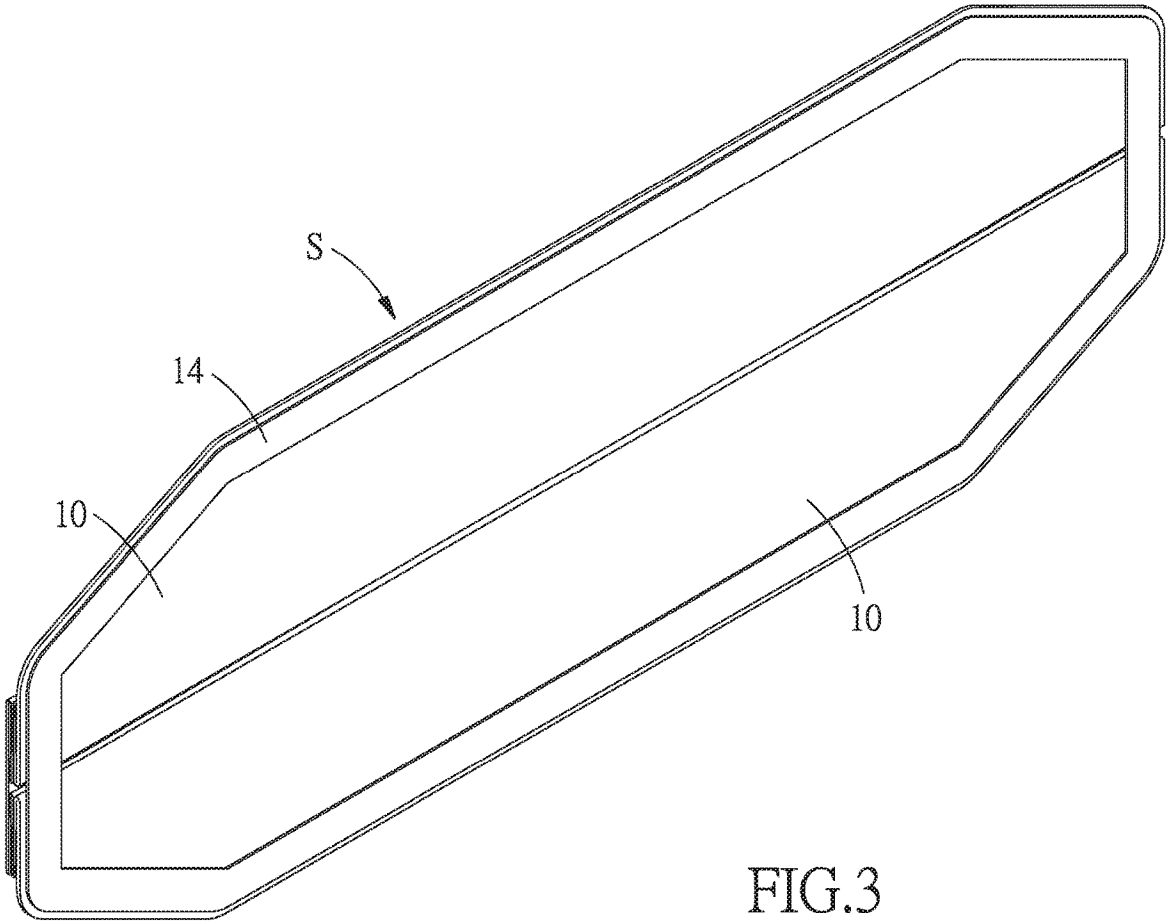
FIG. 3 is a perspective view in accordance with the preferred embodiment of the present invention from another angle showing that the gauze mask with folding lines is folded into a flat package.

An adhesive layer 40 is disposed at another edge of each of the two main pieces 10 opposite the mating edge 101 and located along the transverse direction X. The adhesive layer 40 is located on a surface of each of the two main pieces 10 for contacting the user's face, as shown in FIG. 2. In this embodiment, the adhesive layer 40 is annularly located around the periphery of the main pieces 10 and the press connecting portion P, as shown in FIG. 3.

As mentioned above, the gauze mask S of the present invention is formed by sequentially connecting the main piece 10, the first folding piece 201, the second folding piece 202, the third folding piece 203, the main covering portion 30, the third folding piece 203, the second folding piece 202, the first folding piece 201, and the main piece 10.

Figure 9:
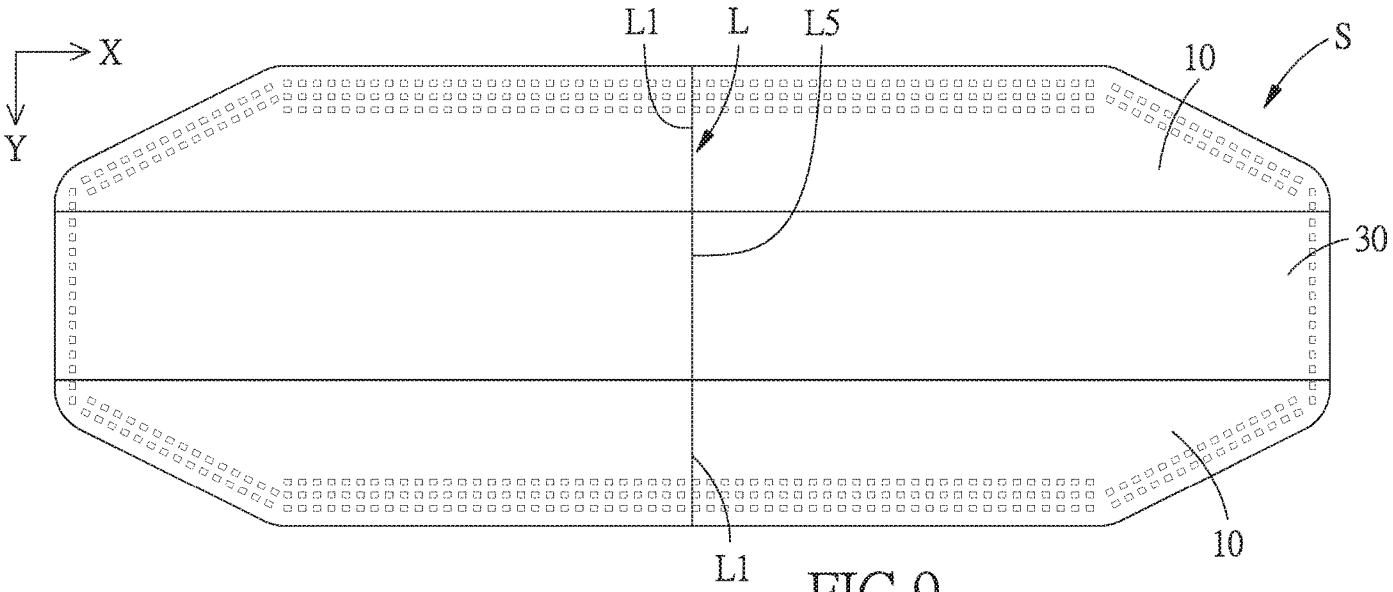
FIG. 9 is a perspective view in accordance with a second preferred embodiment of the present invention showing that the gauze mask with folding lines is folded into a flat package.
Figure 10:
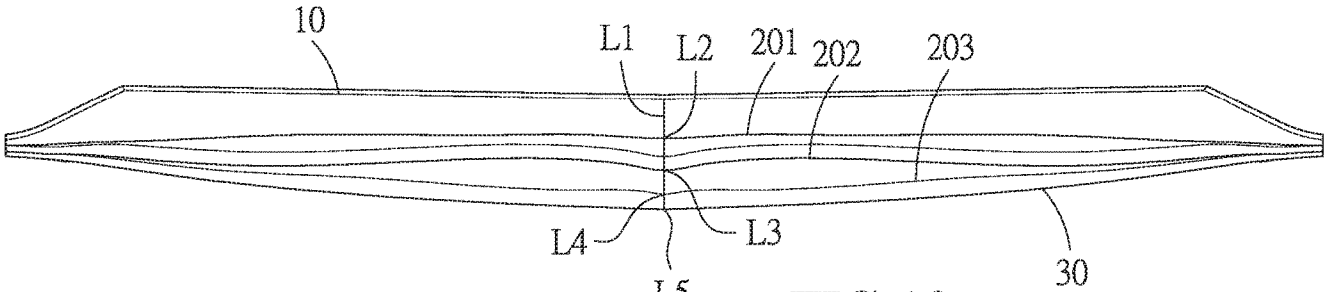
FIG. 10 is a cross sectional view in accordance with the second preferred embodiment of the present invention from another angle showing that the gauze mask with folding lines is unfolded into a three dimensional configuration.
Figure 11:
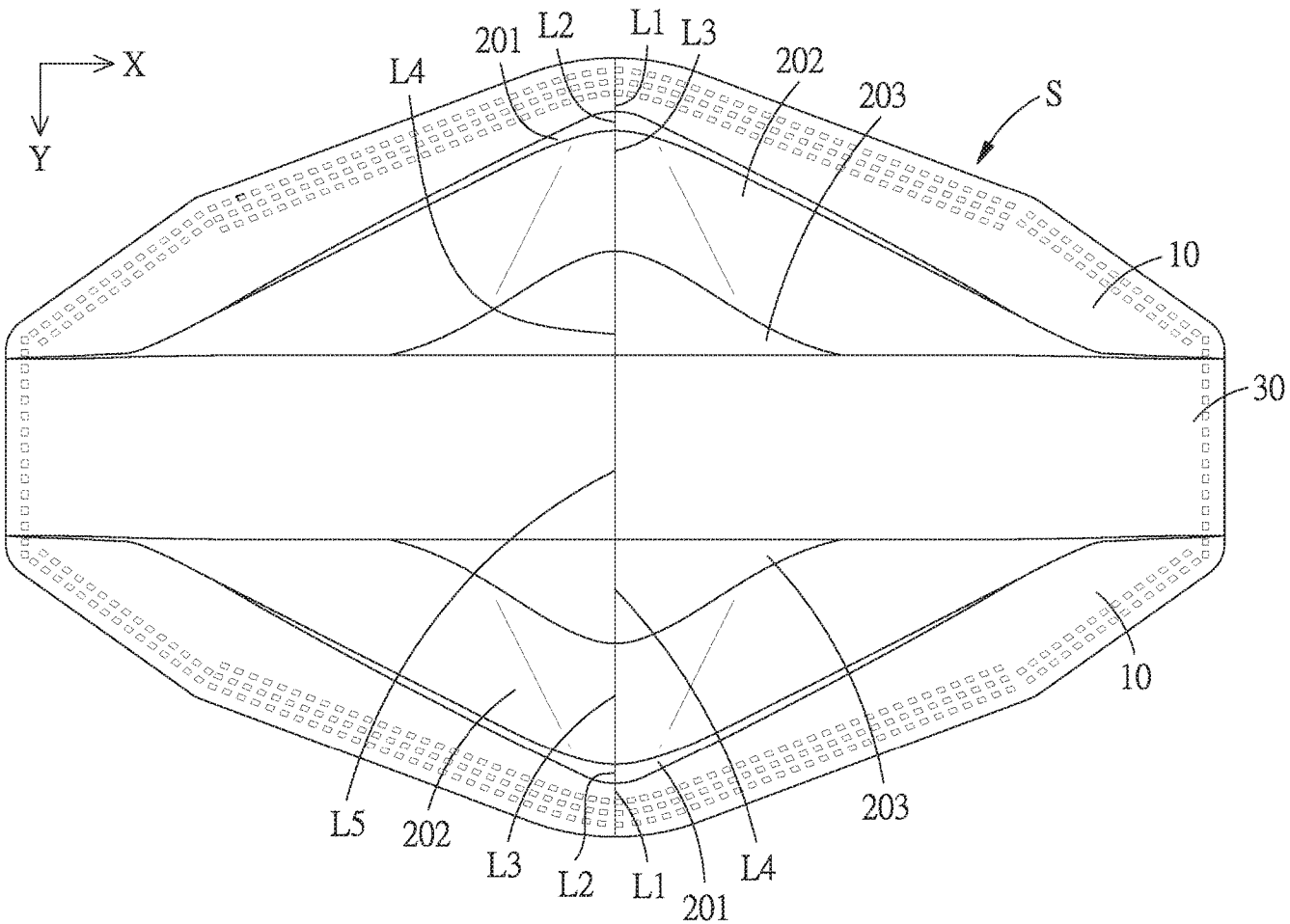
FIG. 11 is a perspective view in accordance with the second preferred embodiment of the present invention from another angle showing that the gauze mask with folding lines is unfolded into a three dimensional configuration.

In the preferred embodiment of the present invention, the gauze mask further includes a three-dimensional folding line L which is located in the center of the gauze mask S in the transverse direction X and extends along the pulling direction Y, as shown in FIGS. 9-11. The three-dimensional folding line L includes a main three-dimensional folding line L1, a first three-dimensional folding line L2, a second three-dimensional folding line L3, a third three-dimensional folding line L4 and an assistant three-dimensional folding line L5. The main three-dimensional folding line L1 is located at the two main pieces 10, the first three-dimensional folding line L2 is located at the first folding pieces 201, the second three-dimensional folding line L3 is located at the second folding pieces 202, the third three-dimensional folding line L4 is located at the third folding pieces 203, and the assistant three-dimensional folding line L5 is located at the main covering portion 30. The main three-dimensional folding line L1, the second three-dimensional folding line L3 and the assistant three-dimensional folding line L5 have the same folding direction which is defined as a first folding direction. The first and third folding lines L2, L4 have the same folding direction which is defined as a second folding direction. When the gauze mask S is in the folded position, the first folding direction is opposite to the second folding direction. When the gauze mask is in the unfolded position, the first folding direction is the same as the second folding direction. Since the three-dimensional folding line L extends in a continuous manner, when in the unfolded position, the main three-dimensional folding line L1, the first three-dimensional folding line L2, the second three-dimensional folding line L3, the third three-dimensional folding line L4 and the assistant three-dimensional folding line L5 will be connected together to form a continuous arc-shaped line, so that the support force is focused on the three-dimensional folding line L to increase the support force of the gauze mask S.

Figure 14:
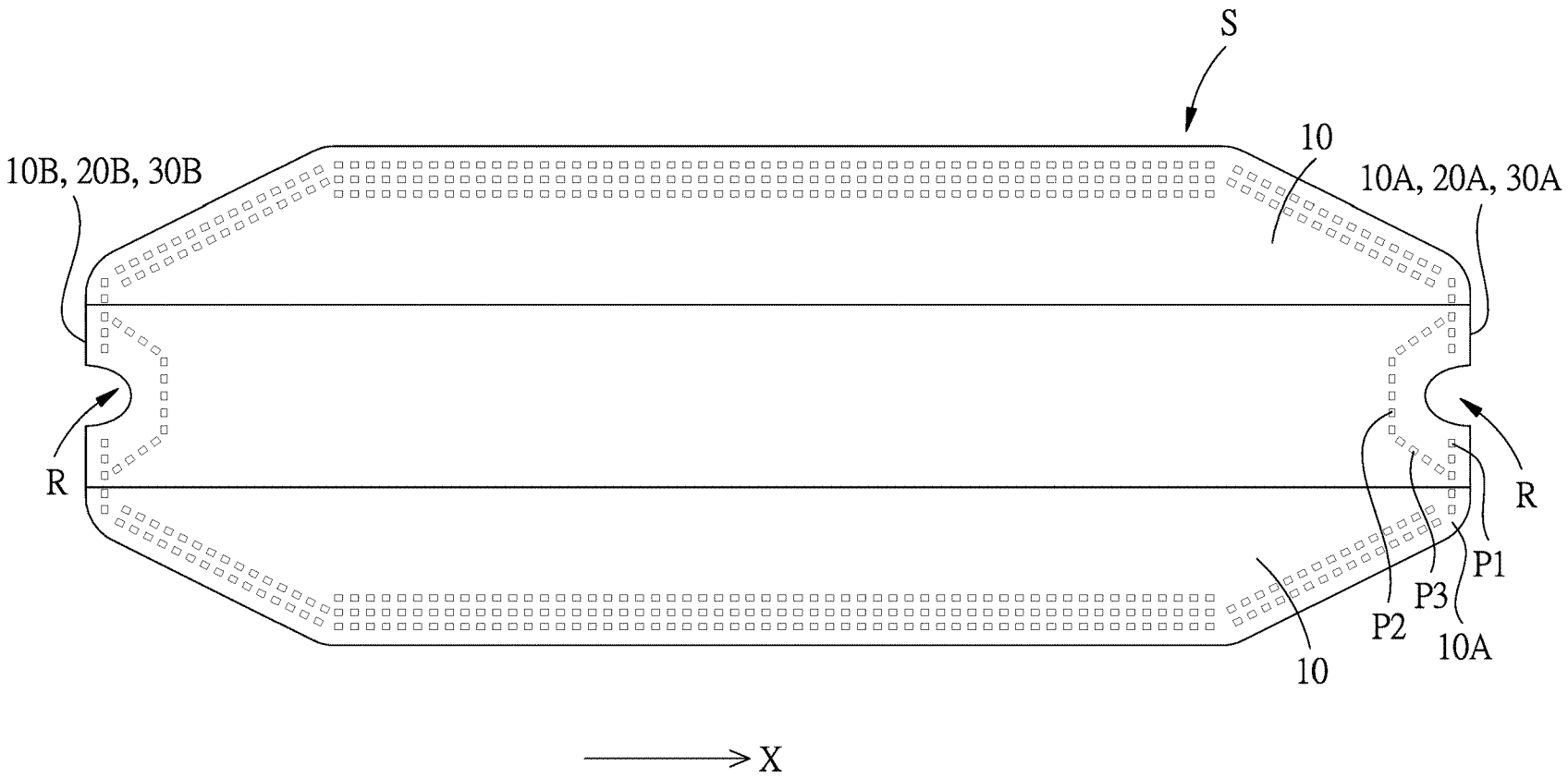
FIG. 14 is another plan view in accordance with the second preferred embodiment of the present invention showing that the gauze mask with folding lines is folded into a flat package.

In another preferred embodiment of the present invention, as shown in FIG. 14, the gauze mask S is provided with a relief notch R at the first ends 10A, 20A and 30A and the second ends 10B, 20B and 30B , so that the portion of the gauze mask S at both sides of the relief notch R will come into the relief notch R and be stacked upon one another, which prevents the connecting portions of the main pieces 10 and the folding portions 20 at the first ends 10A, 20A and 30A and the second ends 10B, 20B and 30B from getting wrinkled and affecting the sealing performance, when the gauze mask S is unfolded.

As mentioned above, the gauze mask S of the present invention has the two folding portions 20 connected to the main covering portion 30 and the two main pieces 10. Since each of the two folding portions 20 includes at least three folding pieces 200, when in use, the folding pieces 200 will be stretched out and prop up one another, which provides a better support and enables to the gauze mask S to be unfolded into a three dimensional structure.

With the arrangement of the main covering portion 30, the main pieces 10 and the folding portions 20 enables the formation of the three-dimensional folding line L, which makes the support force more focused when the gauze mask S is unfolded into a three dimensional configuration.

Besides, the relief notch R at the first ends 10A, 20A and 30A and the second ends 10B, 20B and 30B prevents the connecting portions of the main pieces 10 and the folding portions 20 at the first ends 10A, 20A and 30A and the second ends 10B, 20B and 30B from getting wrinkled and affecting the sealing performance of the gauze mask S.

While we have shown and described various embodiments in accordance with the present invention, it is clear to those skilled in the art that further embodiments may be made without departing from the scope of the present invention.

What is claimed is:

1. A gauze mask with folding lines capable of enabling the gauze mask to be folded into a flat package or unfolded into a three dimensional configuration, comprising: two main pieces, two folding portions and a main covering portion which are connected to one another and extend along a transverse direction, wherein each of the main pieces, the folding portions and the main covering portion includes a first end and a second end along the transverse direction, the first ends of the main pieces, the folding portions and the main covering portion are stacked one upon another, and the second ends of the main pieces, the folding portions and the main covering portion are also stacked one upon another, each of the main pieces, the folding portions and the main covering portion includes a press connecting portion which is located at each of positions where the first ends and the second ends of the main pieces, the folding portions and the main covering portion are stacked one upon another;

the two main pieces are arranged in a pulling direction which is in perpendicular to the transverse direction, and are designed to rest against a user's face;

the two folding portions are connected between the two main pieces and the main covering portion, and each include at least three folding pieces which are connected one another in sequence;

two ends of the main covering portion in the pulling direction are connected to the two folding portions; and an adhesive layer is disposed at the two main pieces to adhere the main pieces to the user's face;

when in a folded position, the two main pieces are located adjacent to each other, and the folding pieces are stacked upon one another, and when in a unfolded position, the two main pieces are located farther away from each other along the transverse direction, the first and second ends of the two main pieces are still stacked upon one another, while the folding pieces are pulled away from one another in a non-stacked manner, so as to form a three dimensional structure;

wherein the at least three folding pieces of each of the folding portions are a first folding piece, a second folding piece and a third folding piece, the first folding pieces are connected to the main pieces, respectively, a first folding line is formed at each of the positions where the first folding pieces connect the main pieces, a second folding line is formed at each of the positions where the first and second folding pieces are connected is defined, a third folding line is formed at each of the positions where each of the third folding pieces is connected to a corresponding one of the second folding pieces, the third folding pieces are connected to the main covering portion, a fourth folding line is formed at each of the positions where the main covering portion connects the third folding pieces;

when in the folded position, the first, second and third folding pieces extend along the pulling direction, and are arranged in a parallel side-by-side relation along a three-dimensional direction which is perpendicular to the transverse direction and the pulling direction, and when in the unfolded position, the first, second and third folding pieces are stretched out and prop up one another.

2. The gauze mask as claimed in claim 1, wherein the first and third folding lines have a same folding direction, and the second and fourth folding lines have a same folding direction.

3. A gauze mask with folding lines capable of enabling the gauze mask to be folded into a flat package or unfolded into a three dimensional configuration, comprising: two main pieces, two folding portions and a main covering portion which are connected to one another and extend along a transverse direction, wherein each of the main pieces, the folding portions and the main covering portion includes a first end and a second end along the transverse direction, the first ends of the main pieces, the folding portions and the main covering portion are stacked one upon another, and the second ends of the main pieces, the folding portions and the main covering portion are also stacked one upon another, each of the main pieces, the folding portions and the main covering portion includes a press connecting portion which is located at each of positions where the first ends and the second ends of the main pieces, the folding portions and the main covering portion are stacked one upon another, the main covering portion, the main pieces and the folding portions include a continually extending three-dimensional folding line;

the two main pieces are arranged in a pulling direction which is in perpendicular to the transverse direction, and are designed to rest against a user's face;

the two folding portions are connected between the two main pieces and the main covering portion, and each include at least three folding pieces which are connected one another in sequence;

two ends of the main covering portion in the pulling direction are connected to the two folding portions; and an adhesive layer is disposed at the two main pieces to adhere the main pieces to the user's face;

when in a folded position, the two main pieces are located adjacent to each other, and the folding pieces are stacked upon one another, and when in a unfolded position, the two main pieces are located farther away from each other along the transverse direction, the first and second ends of the two main pieces are still stacked upon one another, while the folding pieces are pulled away from one another in a non-stacked manner, so as to form a three dimensional structure;

wherein the at least three folding pieces of each of the folding portions are a first folding piece, a second folding piece and a third folding piece, the first folding pieces are connected to the main pieces, respectively, a first folding line is formed at each of the positions where the first folding pieces connect the main pieces, a second folding line is formed at each of the positions where the first and second folding pieces are connected is defined, a third folding line is formed at each of the positions where each of the third folding pieces is connected to a corresponding one of the second folding pieces, the third folding pieces are connected to the main covering portion, a fourth folding line is formed at each of the positions where the main covering portion connects the third folding pieces;

the three-dimensional folding line includes a main three-dimensional folding line, a first three-dimensional folding line, a second three-dimensional folding line, a third three-dimensional folding line and an assistant three-dimensional folding line, the main three-dimensional folding line is located at the two main pieces , the first three-dimensional folding line is located at the first folding pieces, the second three-dimensional folding line is located at the second folding pieces, the third three-dimensional folding line is located at the third folding pieces, and the assistant three-dimensional folding line is located at the main covering portion;

when in the folded position, the first, second and third folding pieces extend along the pulling direction, and are arranged in a parallel side-by-side relation along a three-dimensional direction which is perpendicular to the transverse direction and the pulling direction, and when in the unfolded position, the first, second and third folding pieces are stretched out and prop up one another.

4. The gauze mask as claimed in claim 3, wherein the main three-dimensional folding line, the second three-dimensional folding line and the assistant three-dimensional folding line have the same folding direction which is defined as a first folding direction, the first and third folding lines have the same folding direction which is defined as a second folding direction, when in the folded position, the first folding direction is opposite to the second folding direction, and when in the unfolded position, the first folding direction is the same as the second folding direction.

5. The gauze mask as claimed in claim 1, wherein the adhesive layer is annularly located around a periphery of the main pieces and the press connecting portion.

6. The gauze mask as claimed in claim 3, wherein the adhesive layer is annularly located around a periphery of the main pieces and the press connecting portion.

7. The gauze mask as claimed in claim 1, wherein the press connecting portion includes a first edge, a second edge which is spaced from and shorter than the first edge, and two inclined edges connected between the first and second edges so that the press connecting portion is trapezoid-shaped.

8. The gauze mask as claimed in claim 3, wherein the press connecting portion includes a first edge, a second edge which is spaced from and shorter than the first edge, and two inclined edges connected between the first and second edges, so that the press connecting portion is trapezoid-shaped.

9. The gauze mask as claimed in claim 1, wherein the press connecting portion is defined by a first edge and two inclined edges connected to two ends of the second edge.

10. The gauze mask as claimed in claim 3, wherein the press connecting portion is defined by a first edge and two inclined edges connected to two ends of the second edge.

* * * * *